US007624577B2

(12) United States Patent
Patel et al.

(10) Patent No.: US 7,624,577 B2
(45) Date of Patent: Dec. 1, 2009

(54) GAS TURBINE ENGINE COMBUSTOR WITH IMPROVED COOLING

(75) Inventors: Bhawan Patel, Mississauga (CA); Parthasarathy Sampath, Mississauga (CA); Russell Parker, Oakville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 605 days.

(21) Appl. No.: 11/393,758

(22) Filed: Mar. 31, 2006

(65) Prior Publication Data

US 2007/0234727 A1 Oct. 11, 2007

(51) Int. Cl.
*F02C 3/00* (2006.01)

(52) U.S. Cl. ..... 60/752; 60/804

(58) Field of Classification Search ..... 60/751, 60/752, 760, 804

See application file for complete search history.

(56) References Cited

U.S. PATENT DOCUMENTS

| | | | | |
|---|---|---|---|---|
| 2,151,540 | A | 3/1939 | Varga | |
| 2,946,185 | A | 7/1960 | Bayer | |
| 3,213,523 | A | 10/1965 | Boehler | |
| 3,472,025 | A | 10/1969 | Simmons et al | |
| 4,100,733 | A | 7/1978 | Streibel et al. | |
| 4,322,945 | A | 4/1982 | Peterson et al. | |
| 4,404,806 | A | 9/1983 | Bell, III et al. | |
| 5,036,657 | A | 8/1991 | Seto et al. | |
| 5,237,813 | A * | 8/1993 | Harris et al. | 60/804 |
| 5,241,827 | A * | 9/1993 | Lampes | 60/754 |
| 5,253,471 | A | 10/1993 | Richardson | |
| 5,271,219 | A | 12/1993 | Richardson | |
| 5,396,759 | A | 3/1995 | Richardson | |
| 5,400,968 | A | 3/1995 | Sood | |
| 5,419,115 | A | 5/1995 | Butler et al. | |
| 5,423,178 | A | 6/1995 | Mains | |
| 5,570,580 | A | 11/1996 | Mains | |
| 5,579,645 | A | 12/1996 | Prociw et al. | |
| 5,598,696 | A | 2/1997 | Stotts | |
| 5,771,696 | A | 6/1998 | Hansel et al. | |
| 5,848,525 | A | 12/1998 | Spencer | |
| 5,956,955 | A | 9/1999 | Schmid | |
| 5,983,642 | A | 11/1999 | Parker et al. | |
| 5,996,335 | A | 12/1999 | Ebel | |
| 6,079,199 | A * | 6/2000 | McCaldon et al. | 60/800 |
| 6,109,038 | A | 8/2000 | Sharifi et al. | |
| 6,141,968 | A | 11/2000 | Gates et al. | |
| 6,149,075 | A | 11/2000 | Moertle et al. | |
| 6,240,732 | B1 | 6/2001 | Allan | |
| 6,256,995 | B1 | 7/2001 | Sampath et al. | |
| 6,330,791 | B1 * | 12/2001 | Kendall et al. | 60/39.11 |
| 6,463,739 | B1 | 10/2002 | Mueller et al. | |
| 6,761,035 | B1 | 7/2004 | Mueller | |
| 2003/0014979 | A1 | 1/2003 | Summerfield et al. | |
| 2006/0277921 | A1 * | 12/2006 | Patel et al. | 60/804 |

FOREIGN PATENT DOCUMENTS

| | | |
|---|---|---|
| CA | 1013153 | 7/1977 |
| CA | 2307186 | 5/1999 |

* cited by examiner

*Primary Examiner*—Michael Cuff
*Assistant Examiner*—Phutthiwat Wongwian
(74) *Attorney, Agent, or Firm*—Ogilvy Renault LLP

(57) ABSTRACT

A gas turbine engine combustor liner having a plurality of holes defined therein for directing air into the combustion chamber. The plurality of holes provide a greater cooling air flow in regions intermediate each diffuser pipe than in other areas of the combustor liner.

20 Claims, 3 Drawing Sheets

GAS TURBINE ENGINE COMBUSTOR WITH IMPROVED COOLING

TECHNICAL FIELD

The invention relates generally to a combustor of a gas turbine engine and, more particularly, to a combustor having improved cooling.

BACKGROUND OF THE ART

Cooling of combustor walls is typically achieved by directing cooling air through holes in the combustor wall to provide effusion and/or film cooling. These holes may be provided as effusion cooling holes formed directly through a sheet metal liner of the combustor walls. Opportunities for improvement are continuously sought, however, to provide improve cooling, better mixing of the cooling air, better fuel efficiency and improved performance, all while reducing costs.

Further, a new generation of very small turbofan gas turbine engines is emerging (i.e. a fan diameter of 20 inches or less, with about 2500 lbs. thrust or less), however known cooling designs have proved inadequate for cooling such relatively small combustors as larger combustor designs cannot simply be scaled-down, since many physical parameters do not scale linearly, or at all, with size (droplet size, drag coefficients, manufacturing tolerances, etc.).

Accordingly, there is a continuing need for improvements in gas turbine engine combustor design.

SUMMARY OF THE INVENTION

It is therefore an object of this invention to provide a gas turbine engine combustor having improved cooling.

In one aspect, the present invention provides a gas turbine engine combustor housed in a plenum defined at least partially by a casing of the gas turbine engine and supplied with compressed air from a compressor via a plurality of diffuser pipes in fluid flow communication therewith, the combustor comprising a liner enclosing a combustion chamber therewithin, the liner including a dome portion at an upstream end thereof and at least one annular liner wall extending downstream from and circumscribing said dome portion, said liner wall having a plurality of holes defined therein to form an annular cooling band extending around said liner wall immediately downstream of an exit of said diffuser pipes for directing cooling air into the combustion chamber, said plurality of holes within said annular cooling band including a first set of cooling holes disposed within circumferentially spaced regions intermediately located at least between each of said diffuser pipes and a second set of cooling holes disposed outside said regions, wherein said regions having said first set of cooling holes provide a greater cooling air flow therethrough than similarly sized areas of said combustor liner having said second set of cooling holes therein.

In another aspect, the present invention provides a gas turbine engine combustor comprising an annular liner enclosing a combustion chamber, the liner receiving compressed air about an outer surface thereof from a plurality of diffuser pipes in fluid flow communication with a compressor, the liner having means for directing said compressed air into the combustion chamber for cooling, said means providing more cooling air in regions of the liner located immediately downstream of exits of said diffuser pipes and substantially intermediately therebetween.

In another aspect, the present invention provides a gas turbine engine including at least a compressor, a combustor and a turbine in serial flow communication, the compressor including a plurality of diffuser pipes directing compressed air to a plenum surrounding said combustor, the combustor comprising: combustor walls including an inner liner and an outer liner spaced apart to define at least a portion of a combustion chamber therebetween; and a plurality of cooling apertures defined through at least one of said inner and outer liners for delivering said compressed air from said plenum into said combustion chamber, said plurality of cooling apertures defining an annular cooling band extending around said at least one of said inner and outer liners immediately downstream from each exit of said diffuser pipes, said cooling apertures being disposed in a first spacing density in first regions of said annular cooling band intermediate each of said exits of said diffuser pipes, said cooling apertures being disposed in a second spacing density in at least a second region of said annular cooling band outside said first regions and substantially aligned with each of said exits of said diffuser pipes, said annular cooling band having said first regions circumferentially spaced throughout and said second regions disposed between each of said first regions, and wherein said first spacing density is greater than said second spacing density.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
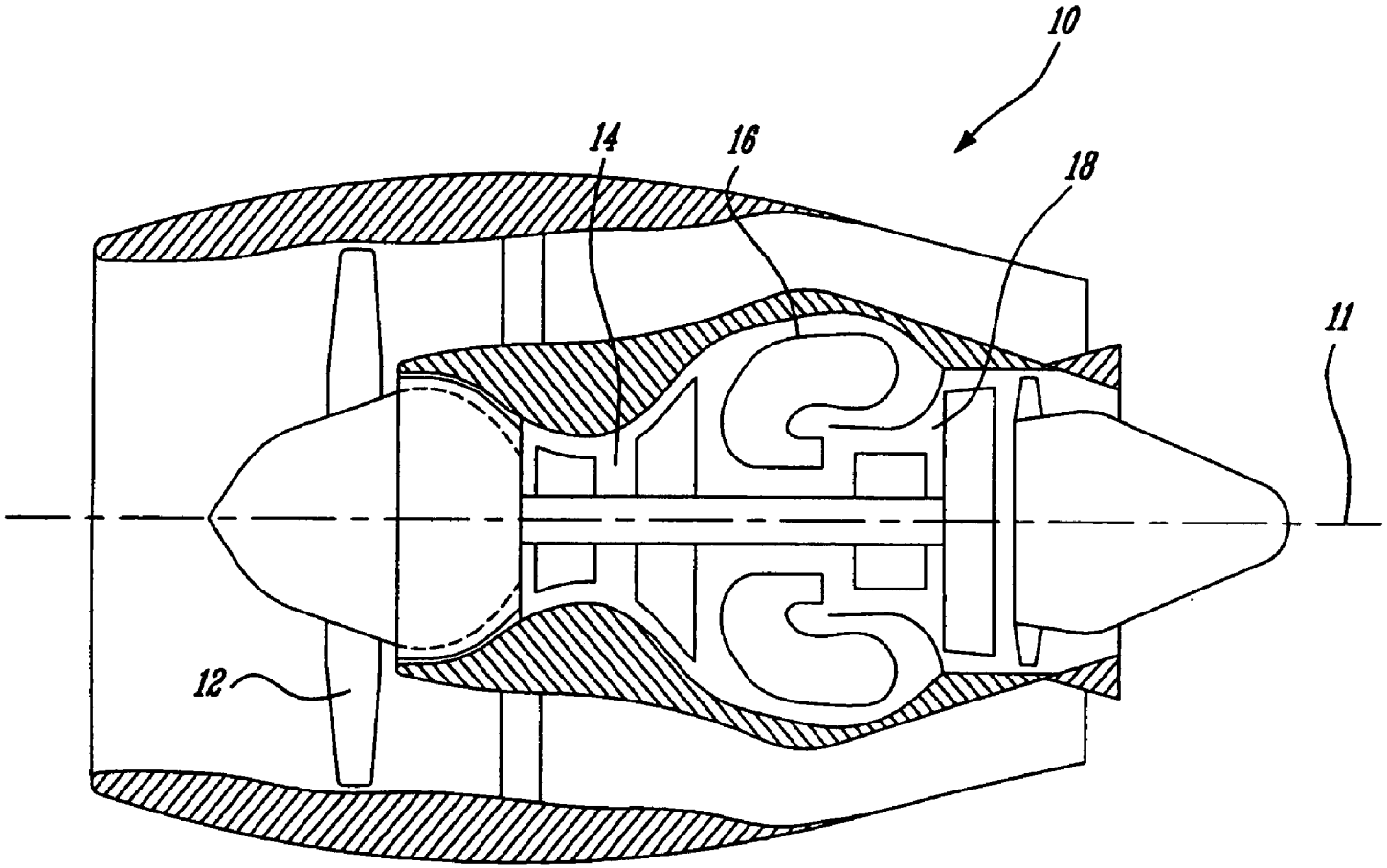
FIG. 1 is a schematic partial cross-section of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
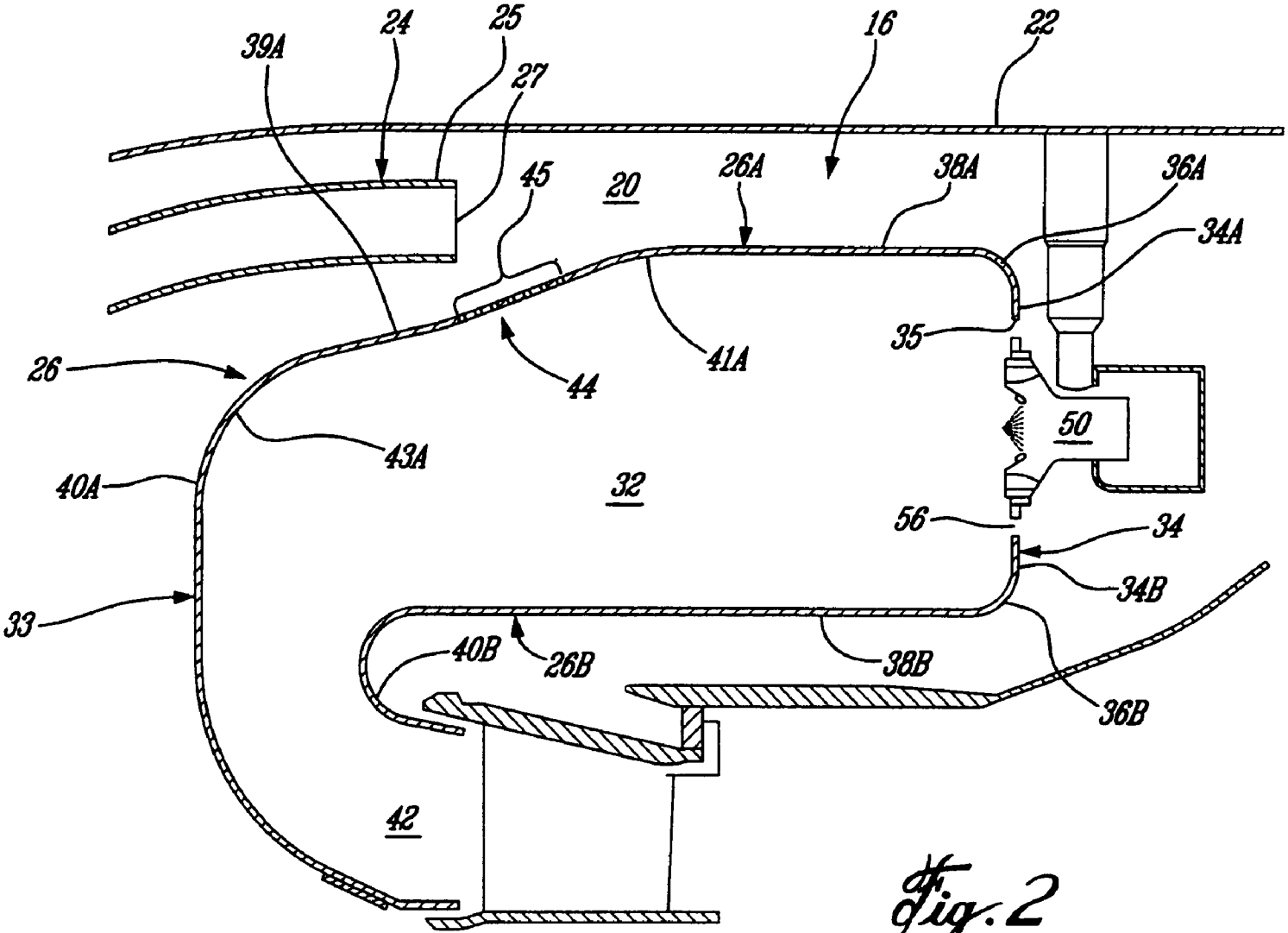
FIG. 2 is partial cross-section of a reverse flow annular combustor having cooling holes in the outer liner wall portion thereof proximate the diffuser pipes, in accordance with one aspect of the present invention.

Referring to FIG. 2, the combustor 16 is housed in a plenum 20 defined partially by a gas generator case 22 and supplied with compressed air from compressor 14 by a diffuser 24, preferably having a plurality of individual diffuser pipes 25. The exits 27 of the diffuser pipes 25 are axially (relative to longitudinal engine axis 11) disposed proximate the outer liner 26A, and between dome portion 34 at an upstream end of the combustor and a downstream end 33 of the combustor 16. Preferably, the exits 27 of the diffuser pipes 25 are axially disposed approximately midway along the liner wall section 39A of the long exit duct portion 40A, as defined in further detail below.

The combustor 16 is preferably, but not necessarily, an annular reverse flow combustor. Combustor 16 comprises generally a liner 26 composed of an outer liner 26A and an inner liner 26B defining a combustion chamber 32 therein.

Combustor 16 preferably has a dome portion 34 at an upstream end thereof, in which a plurality of openings 35 are defined and preferably equally circumferentially spaced around the annular dome portion 34. Each opening 35 receives a fuel nozzle 50 therein for injection of a fuel-air mixture into the combustion chamber 32. The outer and inner liners 26A, 26B comprise panels of the dome portion at their upstream ends and annular liner walls which extend downstream from, and circumscribe, the panels which make up the dome portion 34. Outer liner 26A thus includes an outer dome panel portion 34A, a relatively small radius transition portion 36A, a cylindrical wall portion 38A and a long exit duct portion 40A. A liner wall section 39A of the long exit duct portion 40A extends between a transition point 41A adjacent the cylindrical wall portion 38A at an upstream end and a curved transition 43A further downstream therefrom, wherein the long exit duct portion 40A bends from being a substantially axially extending (relative to longitudinal engine axis 11 as shown in FIG. 1) to substantially radially extending. Inner liner 26B includes an inner dome panel portion 34B, a relatively small radius transition portion 36B, a cylindrical wall portion 38B, and a small exit duct portion 40B. The exit ducts 40A and 40B together define a combustor exit 42 for communicating with the downstream turbine section 18. The combustor liner 26 is preferably, although not necessarily, constructed from sheet metal. The terms upstream and downstream as used herein are intended generally to correspond to direction of gas from within the combustion chamber, namely generally flowing from the dome end 34 to the combustor exit 42.

A plurality of cooling holes 44, preferably used principally for effusion cooling, are provided in liner 26 of the combustor 16, more particularly in the outer liner 26A immediately downstream from of the exits 27 of the diffuser pipes 25. Preferably, the cooling holes 44 are located in the liner wall section 39A of the long exit duct portion 40A of the combustor's outer line 26A, as will be described further below.

In use, compressed air from the gas turbine engine's compressor enters plenum 20 via diffuser 24, which includes a plurality of circumferentially spaced apart diffuser pipes 25. The compressed air which enters the plenum 20 from the exits 27 of the diffuser pipes 25, then circulates around combustor 16 and eventually enters combustion chamber 32 through a variety of apertures defined in the liner 26 thereof, following which some of the compressed air is mixed with fuel for combustion. Combustion gases are exhausted through the combustor exit 42 to the downstream turbine section 18. The air flow apertures defined in the liner include, inter alia, the plurality of cooling holes 44. While the combustor 16 is depicted and described herein with particular reference to the cooling holes 44, it is to be understood that compressed air from the plenum 20 also enters the combustion chamber 32 via other apertures in the combustor liner 26, such as combustion air flow apertures, including openings 56 surrounding the fuel nozzles 50 and fuel nozzle air flow passages, for example, as well as a plurality of other cooling apertures (not shown) which may be provided throughout the liner 26 for effusion/film cooling of the liner walls. Therefore while only the cooling holes 44 are depicted, a variety of other apertures may be provided in the liner for cooling purposes and/or for injecting combustion air into the combustion chamber. While compressed air which enters the combustor, particularly through and around the fuel nozzles 50, is mixed with fuel and ignited for combustion, some air which is fed into the combustor is preferably not ignited and instead provides air flow to effusion cool the wall portions of the liner 26.

Figure 3:
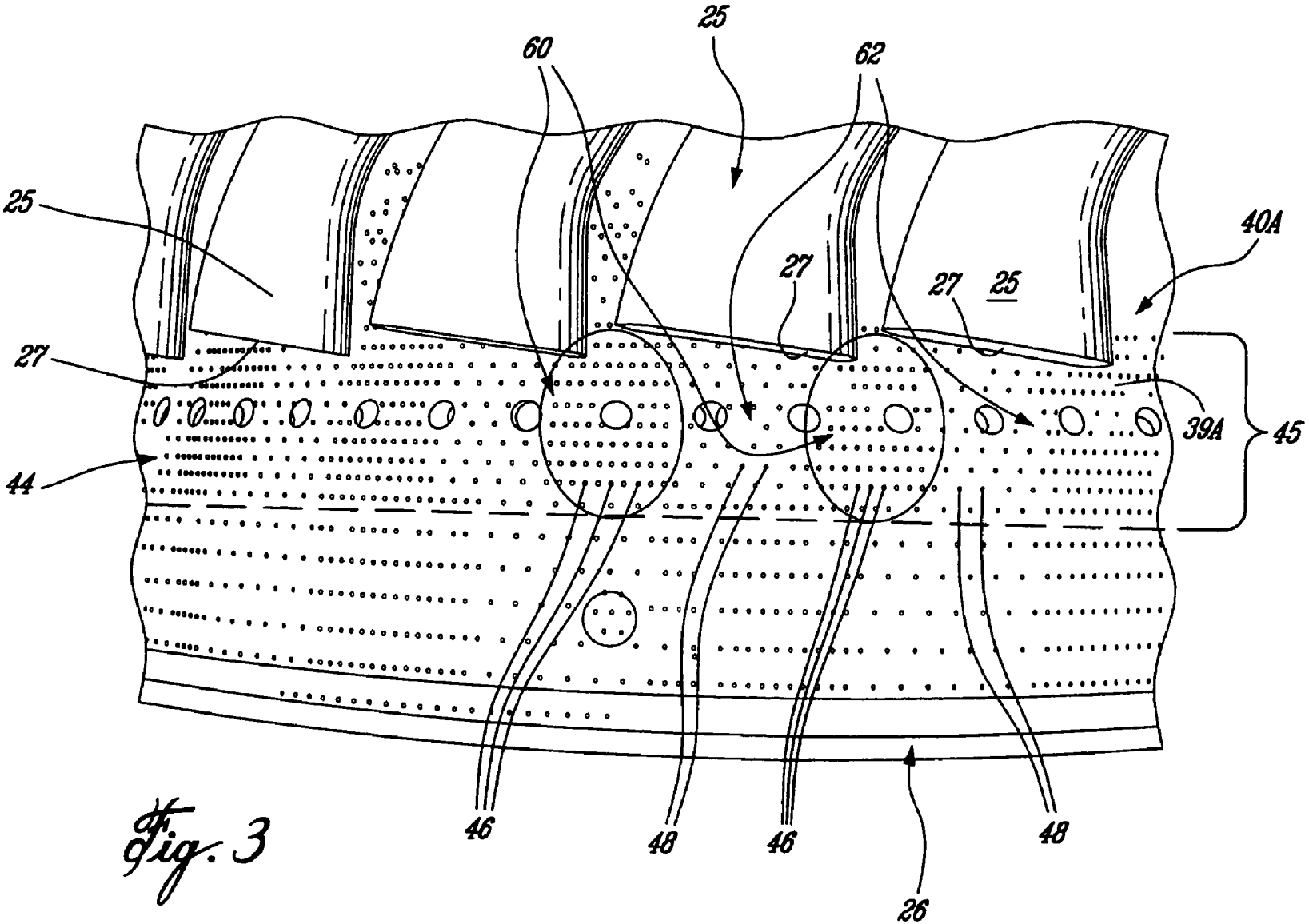
FIG. 3 is top plan view of the combustor outer liner wall portion of FIG. 2.

As best seen in FIG. 3, and as mentioned above with respect to FIG. 2, the combustor liner 26 includes a plurality of cooling air holes 44 formed in the liner wall section 39A of the long exit duct portion 40A thereof, such that effusion cooling is achieved in this general region of the combustor liner, which is closest to the exits 27 of the diffuser pipes 25, by directing air though the cooling holes 44. It has been found, particularly in very small turbofan gas turbine engines (i.e. a fan diameter of 20 inches or less and which produces about 2500 lbs. thrust or less), that hot spots on the long exit duct portion 40A of the combustor liner tend to occur near the diffuser pipes, and particularly between each diffuser pipe just downstream of their exits. Especially for such very small gas turbines, this is at least partly caused by the relatively small radial clearance between the diffuser pipes 25 and the combustor outer liner 26A, which can cause an imbalance of air flow in these regions. Accordingly, the cooling holes 44 are located in the liner wall section 39A of the long exit duct portion 40A immediately upstream of the exits 27 of the diffuser pipes 25. Thus, by ensuring additional cooling air provided by the cooling holes 44 in these regions ahead of the areas identified as likely hot spots, improved cooling effectiveness is provided.

The plurality of cooling holes 44 are preferably angled downstream, such that they direct the cooling air flowing therethrough along the inner surface of the liner wall section 39A of the long exit duct portion 40A. Preferably, all such cooling holes 44 are disposed at an angle of less than about 30 degrees relative to the inner surface of the liner wall.

Referring to the plurality of cooling holes 44 in more detail, the cooling holes 44 comprise an annular band 45 of cooling holes which extend around the long exit duct portion 40A, preferably the liner wall section 39A thereof, and which axially (relative to the engine axis 11) begin proximate the exits 27 of the diffuser pipes 25 and extend at least downstream from the exits (relative to compressed air flow exiting the diffuser pipes) a given distance. While the annular band 45 of cooling holes 44 is preferably located proximate the exits 27 of the diffuser pipes 25, it is to be understood that the band 45 can be disposed at a varied axial location such that it extends either or both upstream and downstream from the exits 27 of the diffuser pipes 25, and for a selected distance in each direction. The plurality of cooling holes 44 within the annular band 45 are comprised generally of at least two main groups, namely first cooling holes 46 and second cooling holes 48.

As shown in FIG. 3, the first and second cooling holes 46,48 are arranged in the outer liner 26A (particularly in the liner wall section 39A of the long exit duct portion 40A thereof) in a selected pattern such that increased cooling air is provided to regions 60, which have been identified as regions of potential local high temperature and/or regions located just upstream of such regions of potential local high temperature. The regions 60 of first cooling holes 46 are circumferentially disposed between each of the diffuser pipes 25, and, at least in the embodiment depicted, axially located immediately downstream (relative to the flow of compressed air out of the diffuser pipes 25) of the exits 27 of the diffuser pipes 25. However, these regions 60, as well as the entire band 45 of holes within which they are disposed, may also extend further forward or rearward in the wall of the combustor, for example such that these regions of holes begin before (i.e. upstream relative to the compressed air flow through the diffuser pipes 25) the exits 27.

In one embodiment, each of these regions 60 define an array, formed of the plurality of first cooling holes 46 therein, the array having a substantially rectangular shape wherein the length thereof (in an axial direction) is greater than a width thereof (in a circumferential direction). However, it is to be understood that other shapes of regions 60 may also be employed, but which will nonetheless preferably correspond to identified regions of local high temperature of the liner wall proximate the diffuser pipes 25.

Thus first cooling holes 46 are defined within the regions 60 in between each circumferentially spaced diffuser pipe 25, and therefore the second cooling holes 48 are defined in the liner wall outside of these regions 60, and at least between each adjacent region 60 within the annular band 45 of cooling holes 44. The second cooling holes 48 thus define regions 62, which are adjacent to and circumferentially spaced between each first region 60 of cooling holes 46. Therefore, the regions 62 of second cooling holes 48 are at least circumferentially disposed between the two circumferentially spaced apart outer edges of the exits 27 of each diffuser pipe 25. However, as depicted in FIG. 3, the regions 62 may not fully extend to the outer edges of the diffuser pipe exits 27, and may thus be more centrally aligned with a central axis disposed at a circumferential midpoint of each diffuser pipe exit 27.

As noted above, at least relative to the cooling airflow provide in regions 62, greater cooling air flow is provided within regions 60 of the liner, which correspond to areas of the liner which are exposed to the locally high temperatures. Preferably, this is accomplished by spacing the first cooling holes 46, within the regions 60, closer together than the second cooling holes 48 within the adjacent regions 62. In other words, the first cooling holes 46 are formed in the liner at a higher spacing density relative to the spacing density of the second cooling holes 48, for any given surface area region of the same size. Thus, in the preferred embodiment, the diameters of the first cooling holes 46 and the second cooling holes 48 are substantially the same, however more first cooling holes 46 are disposed in a given area of liner wall within the regions 60 than second cooling holes 48 in a similarly sized area of the liner wall outside the regions 60. However, it is to be understood that other configurations can also be used to provide more cooling air flow within the identified regions 60 relative to the rest of the combustor liner. For example, the spacing densities of both first and second cooling holes may be the same if the diameters of the first cooling holes 46 are larger than those of the second cooling holes 48, or both the spacing density and the diameters of the first and second cooling holes may be different.

These aspects of the invention are particularly suited for use in very small turbofan engines which have begun to emerge. Particularly, the correspondingly small combustors of these very small gas turbine engines (i.e. a fan diameter of 20 inches or less, with about 2500 lbs. thrust or less) require improved cooling, as the cooling methods used for larger combustor designs cannot simply be scaled-down, since many physical parameters do not scale linearly, or at all, with size (droplet size, drag coefficients, manufacturing tolerances, etc.). The low radial clearance between the diffuser pipes 25 and the combustor liner (best seen in FIG. 2), for example, renders it particularly difficult to avoid high temperature regions on the liner wall proximate the diffuser pipes. Accordingly, the regions 60 of the liner wall section 39A of the long exit duct portion 40A, particularly those for such a small combustor 16, are provided with more localized and directed cooling than other regions of the combustor liner, which may be less prone to local high temperature zones. This is at least partly achieved using the regions 60 of first cooling apertures 46 defined within the regions 60, which direct an optimized volume of coolant to these regions and in a direction which will not adversely effecting the combustion of the air-fuel mixture within the combustion chamber (i.e. by preventing the coolant air from being used as combustion air). By increasing the density of the holes within these regions 60, while reducing hole density in other portions of the combustor liner outside these regions (particularly within the regions 62 of the annular band 45 of cooling holes 44), efficient cooling is maintained while nevertheless providing more cooling air to the regions 60 identified as being at or proximate to local high temperature regions of the combustor liner 26. Thus, the durability of the combustor liner is improved, without adversely affecting the flame out, flame stability, combustion efficiency and/or the emission characteristics of the combustor liner 26. The combustor liner 26 is preferably provided in sheet metal and the plurality of cooling holes 44 are preferably drilled in the sheet metal, such as by laser drilling. However, other known combustor materials and construction methods are also possible.

The above description is meant to be exemplary only, and one skilled in the art will recognize that changes may be made to the embodiments described without department from the scope of the invention disclosed. For example, the invention may be provided in any suitable annular or "cannular" combustor configuration, either reverse flow as depicted or alternately a straight flow combustor, and is not limited to application in turbofan engines. Although the use of holes for directing air is preferred, other means for directing air into the combustion chamber for cooling, such as slits, louvers, openings which are permanently open as well as those which can be opened and closed as required, impingement or effusions cooling apertures, cooling air nozzles, and the like, may be used in place of or in addition to holes. The skilled reader will appreciate that any other suitable means for directing air into the combustion chamber for cooling may be employed. In annular combustors, first and second holes may be provided on one side of the dome only (e.g. annular outside), but not the other (i.e. annular inside), or vice versa. In this application, the term "diffuser pipes" is intended to refer to any diffusing conduits which deliver compressed air from a compressor, such as a centrifugal compressor, to a combustor. Still other modifications which fall within the scope of the present invention will be apparent to those skilled in the art, in light of a review of this disclosure, and such modifications are intended to fall within the literal scope of the appended claims.

The invention claimed is:

1. A gas turbine engine combustor housed in a plenum defined at least partially by a casing of the gas turbine engine and supplied with compressed air from a compressor via a plurality of diffuser pipes in fluid flow communication therewith, the combustor comprising a liner enclosing a combustion chamber therewithin, the liner including a dome portion at a first end thereof and at least one annular liner wall extending from and circumscribing said dome portion, said liner wall having a plurality of holes defined therein to form an annular cooling band extending around said liner wall proximate exits of said diffuser pipes, said annular cooling band extending at least downstream from said exits relative to compressed air flow exiting said diffuser pipes, said plurality of holes within said annular cooling band directing cooling air from the plenum into the combustion chamber, said plurality of holes including a first set of cooling holes disposed within circumferentially spaced apart regions located at least between each of said diffuser pipes and a second set of cooling holes disposed outside said regions, wherein said regions having said first set of cooling holes provide a greater cooling air flow therethrough than similarly sized areas of said combustor liner having said second set of cooling holes therein.

2. The combustor as defined in claim 1, wherein said regions define a substantially rectangular shaped area having a length extending downstream from said exit of said diffuser pipes and a circumferentially extending width, said length being greater said width.

3. The combustor as defined in claim 1, wherein said first set of cooling holes are defined within said regions in a spacing density greater than that of said second set of cooling holes.

4. The combustor as defined in claim 3, wherein axial and circumferential spacing density of said first set of cooling holes within said regions are greater than those of said second set of cooling holes.

5. The combustor as defined in claim 1, wherein each hole of said first set of cooling holes defines a larger cross-sectional opening than that of said second set of cooling holes.

6. The combustor as defined in claim 1, wherein said plurality of holes are effusion cooling holes.

7. The combustor as defined in claim 1, wherein said combustor is an annular reverse flow combustor, and wherein said at least one annular wall comprises an outer and an inner annular wall portion spaced apart such that the dome circumscribed thereby and disposed therebetween is annular, said plurality of holes being located in the outer annular wall portion.

8. The combustor as defined in claim 1, wherein said second set of cooling holes are disposed in areas of said liner wall circumferentially aligned with said exit of said diffuser pipes.

9. A gas turbine engine combustor comprising an annular liner enclosing a combustion chamber, the liner receiving compressed air about an outer surface thereof from a plurality of diffuser pipes in fluid flow communication with a compressor, the liner having means for directing said compressed air into the combustion chamber for cooling, said means being disposed in at least first and second regions of the liner, said first regions being located between exits of said diffuser pipes and which extend downstream from said exits relative to air flow exiting said diffuser pipes, said second regions being located outside said first regions, said means disposed in said first regions providing more cooling air flow into the combustion chamber than said means disposed in said second regions.

10. The combustor as defined in claim 9, wherein said means comprise a plurality of cooling holes, said plurality of holes including first cooling holes disposed within said first regions and second cooling holes disposed within said second regions, wherein said first cooling holes provide a greater cooling air flow therethrough than similarly sized areas of said liner having said second cooling holes therein.

11. The combustor as defined in claim 10, wherein said first cooling holes within said regions are disposed in a spacing density greater than that of said second cooling holes.

12. The combustor as defined in claim 10, wherein each of said first cooling holes defines a larger cross-sectional opening than that of said second cooling holes.

13. The combustor as defined in claim 10, wherein said plurality of holes define an annular cooling band extending around said combustor liner immediately downstream from said exits relative to air flow exiting said diffuser pipes, said annular cooling band having said regions circumferentially spaced throughout, and said second cooling holes being defined within said annular cooling band between each of said first regions.

14. The combustor as defined in claim 13, wherein said second cooling holes are substantially circumferentially aligned with said exits of said diffuser pipes.

15. A gas turbine engine including at least a compressor, a combustor and a turbine in serial flow communication, the compressor including a plurality of diffuser pipes directing compressed air to a plenum surrounding said combustor, the combustor comprising:

combustor walls including an inner liner and an outer liner spaced apart to define at least a portion of a combustion chamber therebetween; and a plurality of cooling apertures defined through at least one of said inner and outer liners for delivering said compressed air from said plenum into said combustion chamber, said plurality of cooling apertures defining an annular cooling band extending around said outer liner immediately downstream from each exit of said diffuser pipes relative to flow of said compressed air therethrough, said cooling apertures being disposed in a first spacing density in first regions of said annular cooling band located between each of said exits of said diffuser pipes, said cooling apertures being disposed in a second spacing density in second regions of said annular cooling band located outside said first regions and being substantially aligned with each of said exits of said diffuser pipes, said annular cooling band having said first regions circumferentially spaced throughout and said second regions disposed between each of said first regions, and wherein said first spacing density is greater than said second spacing density.

16. The gas turbine engine as defined in claim 15, wherein said plurality of cooling apertures are defined through said outer liner of said combustor walls.

17. The gas turbine engine as defined in claim 16, wherein said outer liner defines an axial length between an upstream end and a downstream end thereof, said exits of said diffuser pipes being located therebetween.

18. The gas turbine engine as defined in claim 15, wherein said plurality of cooling apertures are effusion cooling holes.

19. The gas turbine engine as defined in claim 15, wherein said first regions define a substantially rectanguler shaped area having a length axially extending downstream from said exits of said diffuser pipes and a circumferentially extending width, said length being greater said width.

20. The gas turbine engine as defined in claim 15, wherein said combustor is an annular reverse flow combustor, wherein said inner liner and said outer liner are radially spaced apart such that an upstream dome portion of the combustor which is circumscribed thereby and disposed therebetween is annular, said plurality of cooling apertures are defined through said outer liner.

* * * * *